US010266240B2

(12) United States Patent
Pin

(10) Patent No.: US 10,266,240 B2
(45) Date of Patent: Apr. 23, 2019

(54) RACK FOR CARRYING SPORTS EQUIPMENT ALONGSIDE A PERSONAL WATERCRAFT AND A CLAMP OF THE RACK

(71) Applicant: Michael Pin, Labrador (AU)

(72) Inventor: Michael Pin, Labrador (AU)

( * ) Notice: Subject to any disclaimer, the term of this patent is extended or adjusted under 35 U.S.C. 154(b) by 109 days.

(21) Appl. No.: 14/847,014

(22) Filed: Sep. 8, 2015

(65) Prior Publication Data

US 2016/0068234 A1 Mar. 10, 2016

(30) Foreign Application Priority Data

Sep. 9, 2014 (AU) ..... 2014903582

(51) Int. Cl.
*B63B 25/00* (2006.01)
*B63B 35/79* (2006.01)

(52) U.S. Cl.
CPC ..... *B63B 35/7946* (2013.01)

(58) Field of Classification Search
CPC ..... Y10S 224/922; B60R 9/12; A47B 81/005; B63B 35/85; B63B 17/00; B63B 35/7946; B63B 2025/285; B25B 5/166; B25B 5/16; B25B 5/163
USPC ..... 224/406, 558, 571, 543, 401; 114/364, 114/343; 248/201, 447.2, 540, 229.14, 248/229.12, 229.22, 229.24, 226.11, 248/231.85, 245, 689, 231.71; 211/89.01; 280/502
See application file for complete search history.

(56) References Cited

U.S. PATENT DOCUMENTS 4,582,015 A * 4/1986 Hunter ..... B63B 35/85 114/343
4,901,963 A * 2/1990 Yoder ..... B25B 5/103 24/489
5,765,902 A * 6/1998 Love ..... B60J 7/104 248/228.1
6,189,753 B1 2/2001 Kalhok et al.
6,322,030 B1 * 11/2001 Marra ..... B63B 17/00 248/176.1
6,834,609 B2 * 12/2004 Cannon, Jr. ..... B63B 17/00 114/343
7,395,775 B2 * 7/2008 LaScala ..... B63B 17/02 114/361
7,886,677 B2 2/2011 Strom
8,226,074 B1 * 7/2012 Hughey ..... B25B 5/003 269/155
8,833,289 B2 9/2014 Isaac
8,936,182 B2 1/2015 Grasso et al.

FOREIGN PATENT DOCUMENTS

GB 2136281 A * 9/1984 ..... A47B 57/58

* cited by examiner

*Primary Examiner* — Nathan J Newhouse
*Assistant Examiner* — Matthew T Theis
(74) *Attorney, Agent, or Firm* — Martin IP Pty Ltd

(57) ABSTRACT

A rack for carrying sports equipment alongside a personal watercraft. The rack includes a clamp sized and configured to removeably engage a lip of the watercraft, and a carrier with an engagement surface configured to hold an article of sports equipment such as a surfboard.

31 Claims, 14 Drawing Sheets

RACK FOR CARRYING SPORTS EQUIPMENT ALONGSIDE A PERSONAL WATERCRAFT AND A CLAMP OF THE RACK

FIELD OF THE INVENTION

The present description relates to improvements in racks for carrying sports equipment alongside a personal watercraft. More specifically, the present description relates to a clamp of the rack.

BACKGROUND OF THE INVENTION

Personal Watercraft (PWC) are enjoyed for sport and recreation. PWC may also be used in sea rescue and policing. It may sometimes be convenient to carry equipment, such as sport or rescue equipment, on the PWC.

PWC have limited space or holders to carry equipment, especially bulky sports equipment such as surfboards or fishing rods. Carrying frames which bolt onto PWC are known, but these frames have to be customized for specific PWC makes and models. PWC owners may also not want a rack that bolts to the PWC given the permanent nature of bolting a rack to the PWC.

SUMMARY

In one aspect there is described a rack for carrying sports equipment alongside a personal watercraft. The personal watercraft has a hull and a lip extending along a top portion of the hull. The rack includes a clamp sized and configured to engage the lip of the personal watercraft, the clamp having a first engagement surface configured to engage an outwardly-facing portion of the lip, the clamp having a second engagement surface configured to engage an inwardly-facing portion of the lip, the second engagement surface being retractable relative to the first engagement surface. The rack includes a carrier extending from the clamp, the carrier having a length, a height, and at least one generally U-shaped engagement surface configured to hold an article of sports equipment.

In another aspect there is described a clamp for attaching an equipment carrier alongside a watercraft having a hull. The clamp includes a first engagement surface configured to engage an outwardly-facing portion of the hull. The clamp includes a second engagement surface moveably connected to the first engagement surface, the second engagement surface being configured to move towards the first engagement surface to clamp a portion of the hull therebetween. The clamp includes a third engagement surface moveably connected to the first engagement surface, the third engagement surface being moveable relative to the first engagement surface to adjust a clamping angle of the first engagement surface and the second engagement surface relative to the hull of the watercraft.

The second engagement surface may be generally L-shaped.

The first engagement surface may include an aperture configured to receive a portion of the second engagement surface therethrough. The aperture may be a slot. The first engagement surface may be formed as a plate.

Movement of the first engagement surface and the second engagement surface towards each other may require rotation. Rotation may be about an axis parallel to a central longitudinal axis of the aperture or slot.

The clamp may include a turn knob configured to engage a portion of the second engagement surface to move the second engagement surface towards the first engagement surface.

The first engagement surface may be generally L-shaped. The first engagement surface may have a foot portion and an upper free end. The upper free end may be an angled flange. The foot portion may be configured to adjustably engage the third engagement surface.

The third engagement surface may have a length with a free end at one end thereof. The free end may include a foam or rubber hull engagement surface. The third engagement surface may include at least one aperture for receiving a fastener to removeably fasten the third engagement surface to the first engagement surface. The third engagement surface may be a plate having a length and a width. The at least one aperture may be a slot or a series of holes extending perpendicular to the length of the third engagement surface. The third engagement surface may be moveable in a direction generally parallel to the direction of movement between the first engagement surface and the second engagement surface. The first engagement surface may include an aperture configured to receive a projection of the second surface therethrough. The projection may have a central longitudinal axis, the fastener having a central longitudinal axis generally perpendicular to the central longitudinal axis of the projection when the fastener is engaged with the first engagement surface and the third engagement surface.

It is to be understood that both the foregoing general description and the following detailed description are exemplary and explanatory only and are not restrictive of the invention, as claimed. In the present specification and claims, the word "comprising" and its derivatives including "comprises" and "comprise" include each of the stated integers, but does not exclude the inclusion of one or more further integers.

The claims as filed and attached with this specification are hereby incorporated by reference into the text of the present description.

The accompanying drawings, which are incorporated in and constitute a part of this specification, illustrate several embodiments of the invention and together with the description, serve to explain the principles of the invention.

DETAILED DESCRIPTION OF THE DRAWINGS

Figure 1:
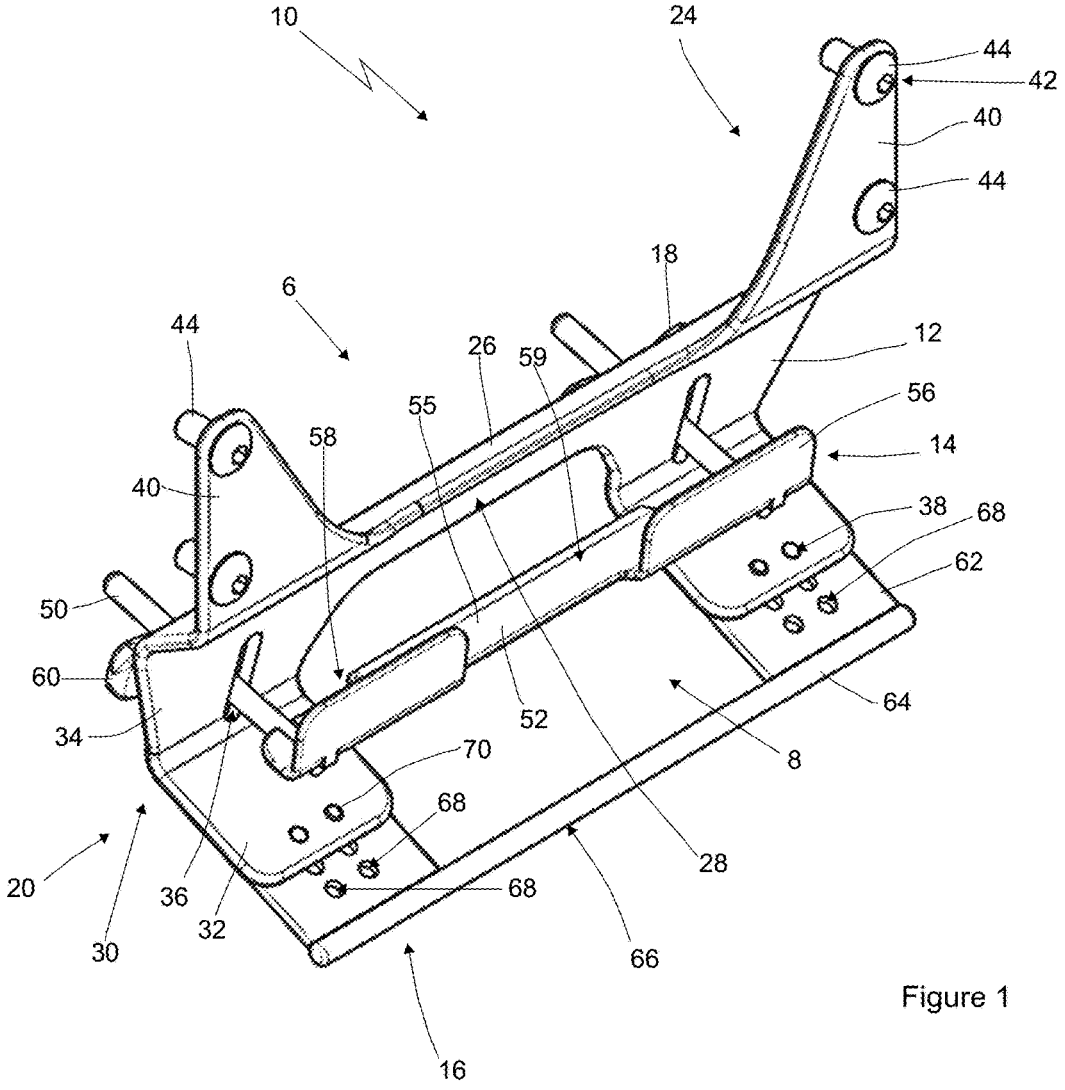
FIG. 1 is a top perspective view of a clamp for clamping a carrier alongside a personal watercraft.

Reference will now be made in detail to the present preferred embodiments of the invention, examples of which are illustrated in the accompanying drawings.

FIGS. 1 to 5 show a preferred embodiment of a clamp 10 sized and configured to engage a lip of a personal watercraft. The preferred elements of clamp 10 and their interrelationship are described below.

Clamp 10 includes a bracket 12, a moveable jaw 14, an adjustable bumper formation 16, and turn knobs 18.

Figure 3:
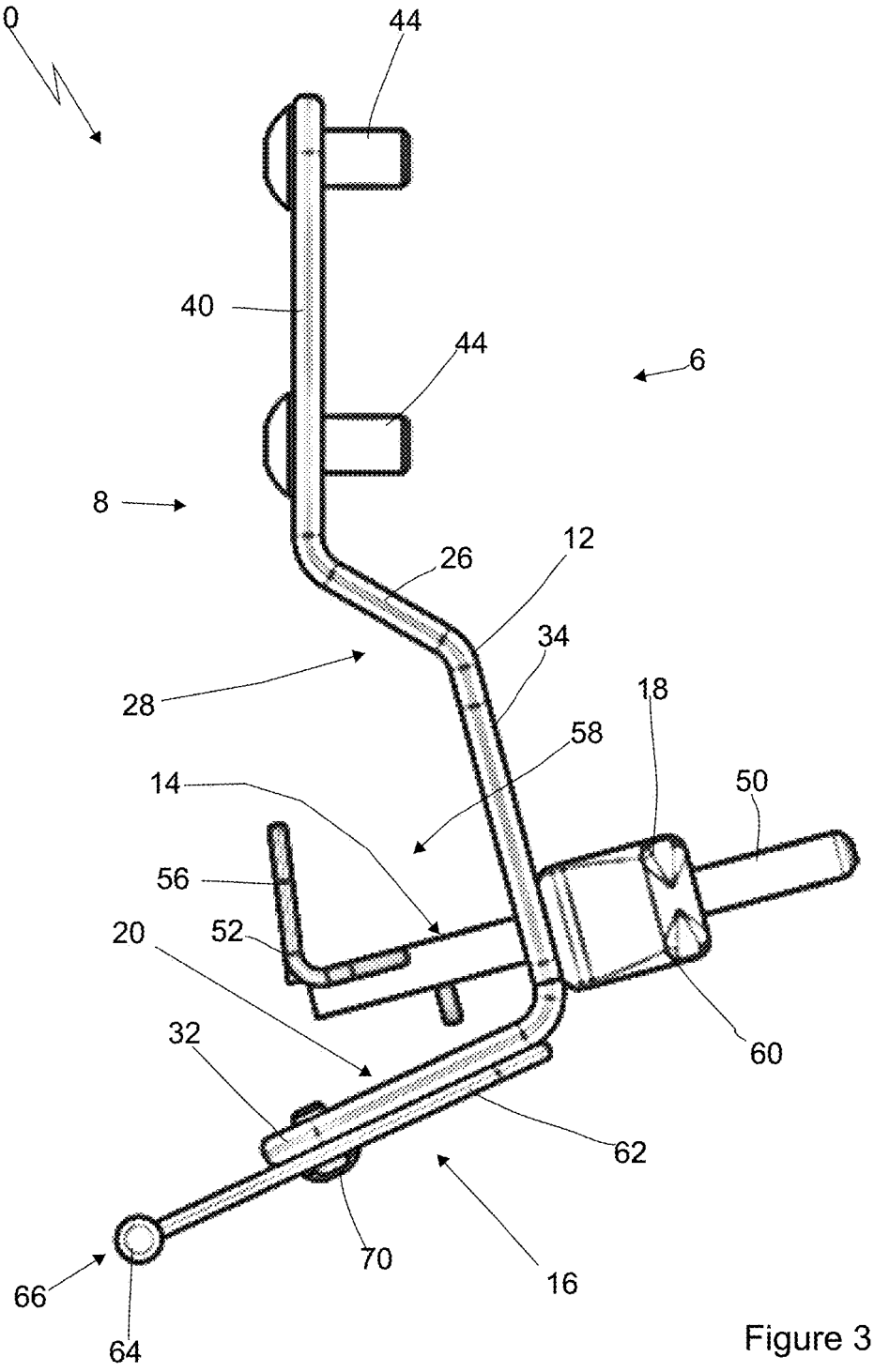
FIG. 3 is an end view of the clamp of FIG. 1.
Figure 4:
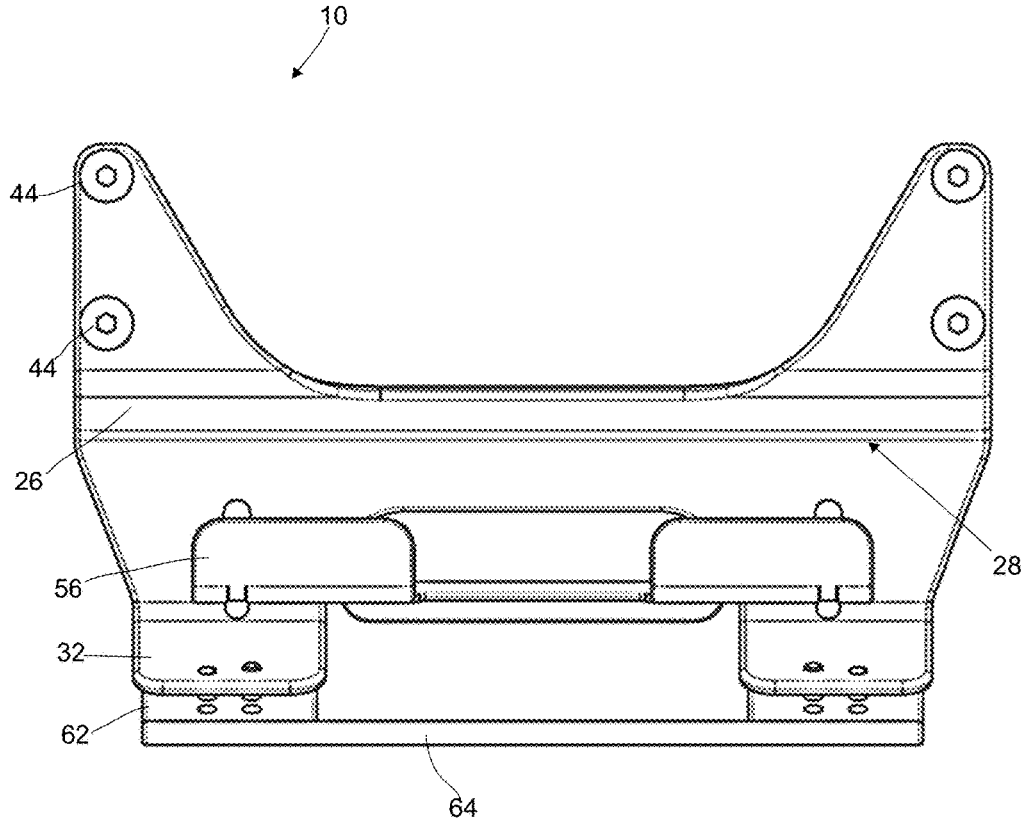
FIG. 4 is a side view of the clamp of FIG. 1.
Figure 5:
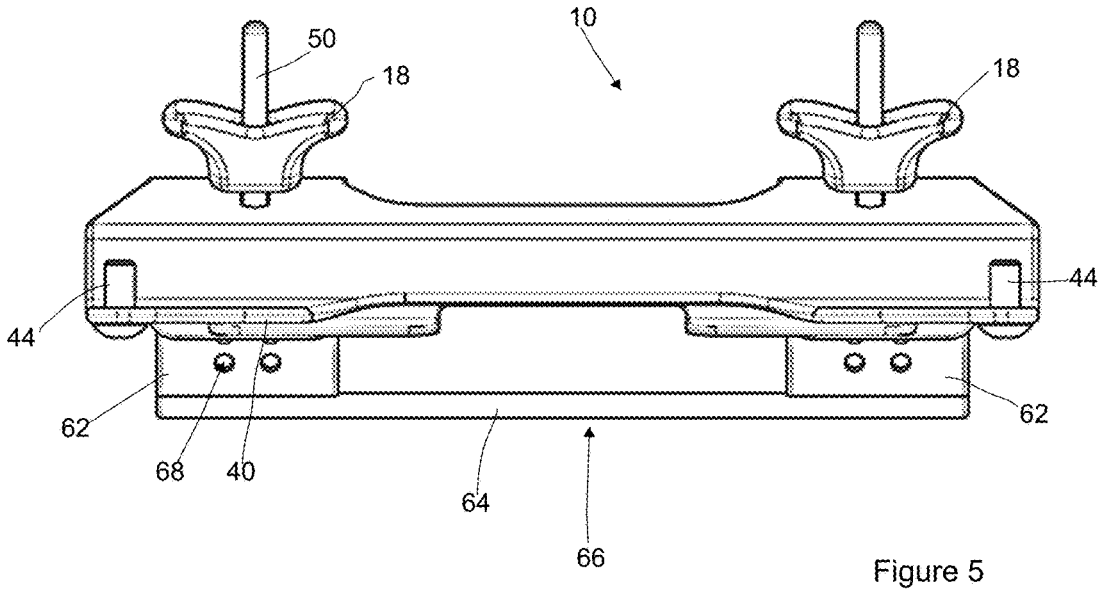
FIG. 5 is a top view of the clamp of FIG. 1.

Bracket 12 is preferably generally L-shaped in end profile view, as shown in FIG. 3. Bracket 12 has an outer side 6 and an inner side 8. Inner side 8 defines a first engagement surface 28. Bracket 12 includes a foot portion 20 and an upper free end 24. An angled flange 26 extends between foot portion 20 and free end 24.

Foot portion 20 includes two spaced apart feet 30. Each foot 30 has a flat base plate 32 and a web 34 which extends from a proximate end of base plate 32. Base plate 32 and web 34 are generally square relative to each other. Each web 34 extends between one of the base plates 32 and angled flange 26.

Webs 34 each include an aperture in the form of an elongate slot 36. Slots 36 extend between respective base plates 32 and angled flange 26. Slots 36 have a longitudinal axis which is perpendicular to the direction of the elongation of slot 36.

Each base plate 32 has a pair of spaced-apart threaded holes 38. Holes 38 are internally threaded for receiving and engaging a shank of a threaded fastener such as a screw.

Upper free end 24 includes a pair of upright ears or mounting flanges 40. Mounting flanges 40 are integrally formed with angled flange 26. Mounting flanges 40 have spaced holes 42 therein for receiving fasteners such as bolts 44.

Bracket 12 may be formed from a flat plate which is cut and bent to shape or may be moulded from plastics or composite material. Bracket 12 may be aluminium or stainless steel material, or can be of other suitable materials such as plastics materials, fibreglass reinforced materials, or carbon fibre-based materials. Foot portion 20, angled flange 26 and mounting flanges 40 are all integrally formed with each other.

Different types of equipment carriers may be fastened or bolted onto bracket 12 by being mounted to flanges 40. Bracket 12 is not limited to any particular type of carrier and different carriers may be interchanged for different purposes. Some example carrier types include a U-shaped carrier as described in more detail with reference to FIGS. 9-11 and a fishing rod holder as described with reference to FIG. 12.

Referring to FIG. 3, angled flange 26 is angled inwardly from webs 34 at approximately between 30° and 60° relative to webs 34, for example angled at approximately 45°.

Referring to FIGS. 1 and 3, jaw 14 is generally L-shaped in end profile view of clamp 10. Jaw 14 includes projections in the form of arms 50 and a grip formation 52 fixed to distal ends of arms 50. Arms 50 have a central longitudinal axis along the length of arms 50. Grip formation 52 extends between the distal ends of arms 50. Arms 50 are received through slots 36 to facilitate adjustable engagement of bracket 12. Arms 50 are displaceable in the longitudinal direction into and out of the slots 36 to move grip formation 52 closer and further away from bracket 12. Arms 50 can also move up and down in slots 36.

Arms 50 have portions which are threaded. Turn knobs 18 screw onto the threaded portions of arms 50.

As shown in FIGS. 1 and 3, turn knobs 18 include finger grips 60 by which knobs 18 can be gripped for rotating knobs 18. Turn knobs 18 include a passage in which arms 50 of jaw 14 are received. The passage is internally threaded or has an embedded nut for engaging the threaded section of arms 50. Turn knobs 18 are thus able to travel along arms 50 when rotated. Rotating turn knobs 18 in one direction moves turn knobs in one axial direction along arms 50, for example closer to grip formation 52. Rotating turn knobs 18 in the other direction moves turn knobs 18 in the opposite axial direction along arms 50, for example away from grip formation 52. The axial displacement of turn knobs 18 is in a direction parallel to the longitudinal axis of slots 36.

Other mechanisms may be used to move jaw 14 relative to bracket 12. For example, bracket 12 may have a series of internally threaded holes rather than slots 36. Arms 50 may screw into the holes and be rotatable relative to grip formation 52. Rotating the arms by means of a finger grips or a hand tool may then move or displace jaw 14 relative to bracket 12.

Figure 2:
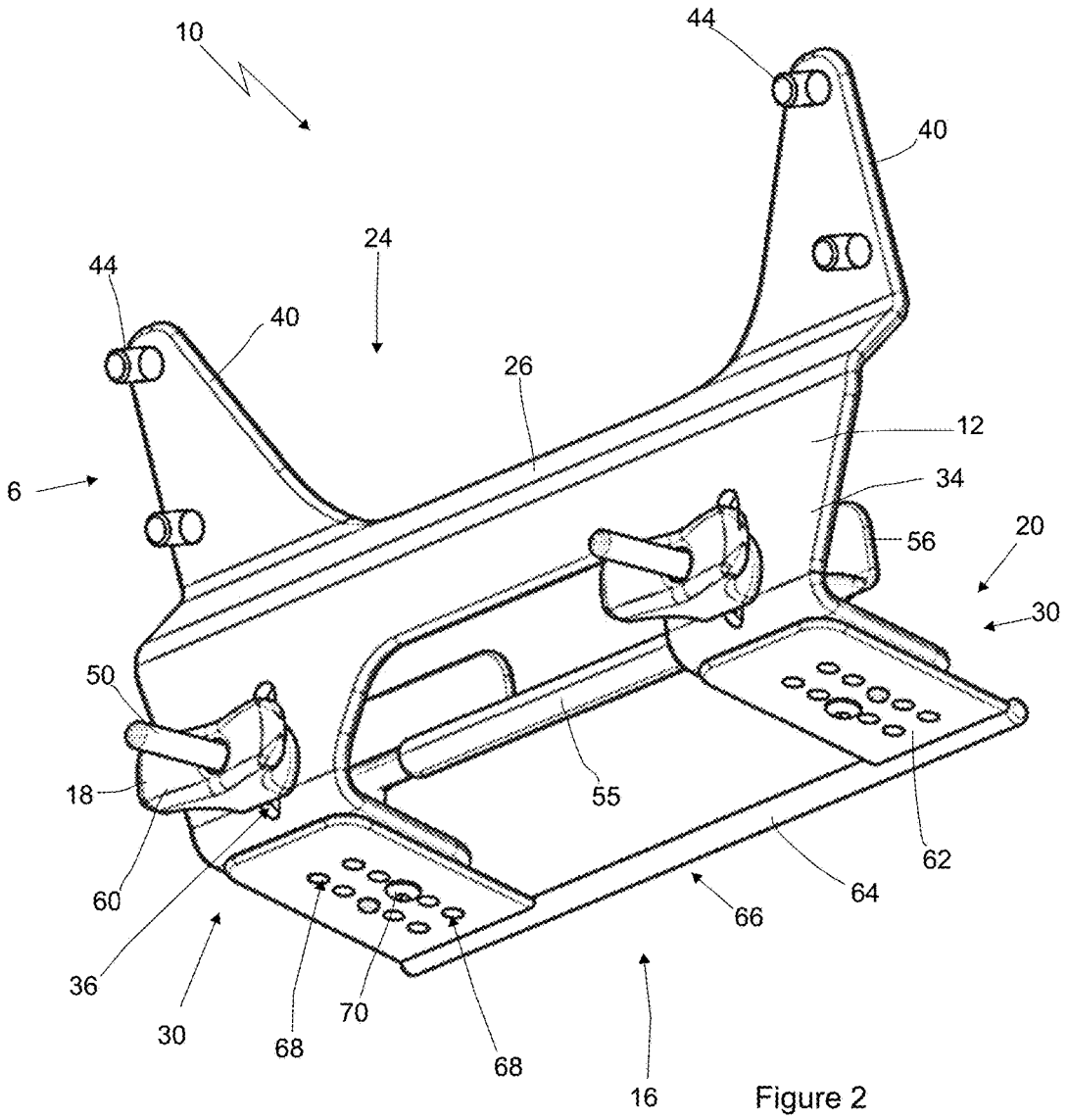
FIG. 2 is a bottom perspective view of the clamp of FIG. 1.

As shown in FIGS. 1 and 2, grip formation 52 has a floor 55 and two upright tabs 56 at a distal end of floor 55. Tabs 56 extend generally perpendicular to the longitudinal axis of arms 50. A second engagement surface 58 is defined along the inside of jaw 14. Second engagement surface 58 includes the insides of tabs 56 and the upper surface of floor 55.

In another embodiment, jaw 14 may include two separate arms 50 which are not connected by grip formation 52. Each arm 50 will then have the tab 56 at its distal end and be displaceable separately from the other arm 50.

Referring to FIGS. 2 and 3, bumper formation 16 includes two slider plates 62 and a bumper bar 64 at a free end of bumper formation 16. Slider plates 62 are fixed to bumper bar 64 at opposite end regions of bumper bar 64. Bumper bar 64 may be covered or wrapped in a resiliently deformable material such as foam or rubber. Alternatively, bumper bar 64 may be made of resiliently deformable material such as dense foam or rubber. Bumper bar 64 defines a third engagement surface 66 on the side of bar 64 diametrically opposite slider plates 62. Each slider plate 62 has two series of holes 68 for receiving a shank of a threaded fastener such as a bolt or screw. The two series of holes 68 are parallel relative to each other. Bumper formation 16 is releasably fastened to base plates 32 by means of screws 70 as shown in FIG. 3. Screws 70 may be hex socket pan head screws having a central longitudinal rotational axis. The heads of the screws 70 abut the underside of slider plates 62. The shanks of screws 70 extend through holes 68 in the slider plates 62 to screw into holes 38 in base plates 32. Slider plates 62 engage the underside of base plates 32. Slider plates 62 may additionally by locked to base plates 32 by locking pins or dells which extend through holes 68 to be received in holes 38.

Bumper formation 16 can slide forward or backwards relative to base plates 32 to extend and retract bumper formation 16 by selecting different holes 68 to be in register with holes 38 in base plates 32. That is to say that the extension of bumper formation 16 from base plates 32 can be set at increments being the spacing between holes 68. Bumper formation 16 moves in a direction generally parallel to the direction of travel of jaw 14 when clamping clamp 10 to a lip of the watercraft. Bumper formation 16 can be offset from side to side by selecting different series of holes 68 in slider plate 62 to be in register with holes 38 in base plates 32. Bumper formation 16 may also be angled in a plane parallel to the plane of the base plates 32 by particular selection of holes 68 in slider plate 62 to be in register with holes 38 in base plates 32.

Having described the preferred components of clamp 10, a preferred method of attaching clamp 10 to the side of a personal watercraft will now be described with reference to FIGS. 6-8.

Figure 6:
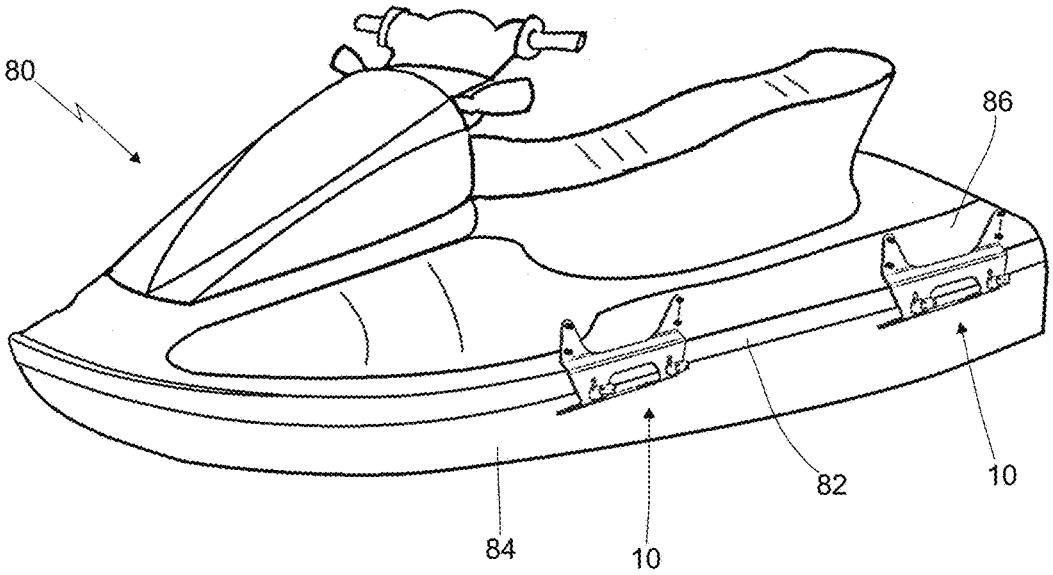
FIG. 6 is a perspective view of two of the clamps of FIG. 1, clamped to a personal watercraft.

FIG. 6 shows a personal watercraft (PWC) 80 and two clamps 10 clamped to the side of PWC 80. Different types and makes of PWC are sometimes referred to as a water scooter, Jet Ski, WaveRunner or Sea-Doo, to name but a few. Clamp 10 is configured to engage any PWC having a lip connecting the deck and the hull of the PWC.

PWC 80 has a lip 82 which extends along the sides of PWC 80. Lip 82 is formed where a hull 84 of PWC 80 is attached to a deck 86 of PWC 80. Lip 82 extends along a top portion of hull 84.

Figure 7:
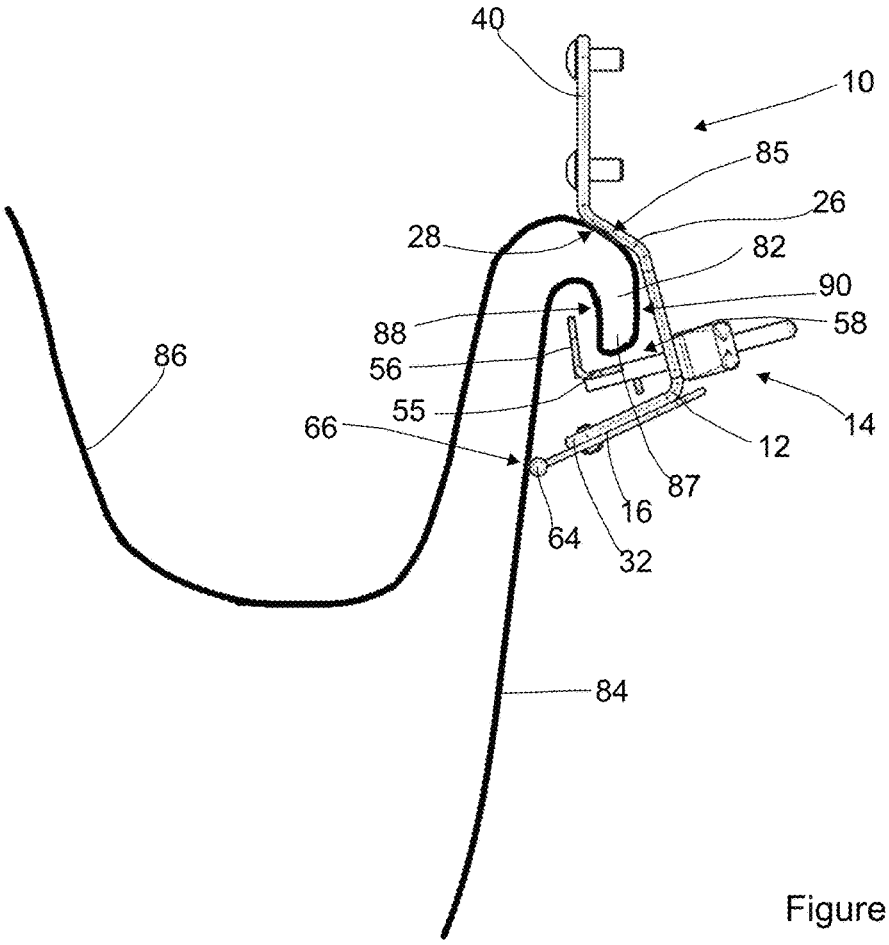
FIG. 7 is a sectional view of the clamp of FIG. 1, mounted for clamping to the personal watercraft of FIG. 6.
Figure 8:
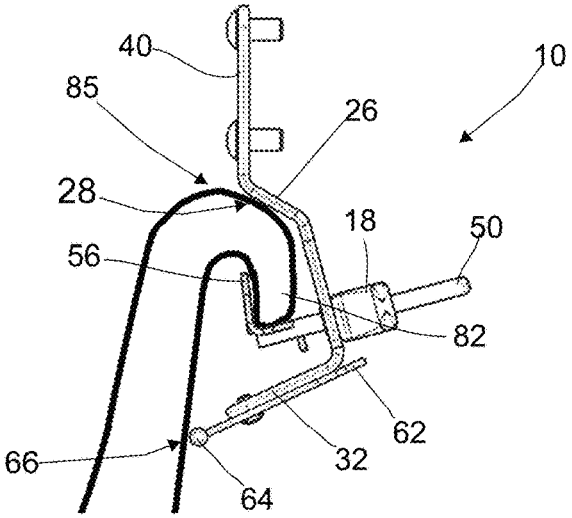
FIG. 8 is a sectional view of the clamp of FIG. 1 in a clamped condition, clamped to the personal watercraft of FIG. 6.

FIGS. 7 and 8 show the cross sectional profile of lip 82. An inwardly facing portion 88 of lip 82 faces inwardly towards hull 84. An outwardly facing portion 90 of lip 82 faces outwardly from PWC 80. Outwardly facing portion 90 includes a rounded upper surface 85. A downwardly depending skirt 87 is defined between inwardly facing portion 88 and outwardly facing portion 90.

Clamp 10 engages lip 82 by clamping to lip 82. As a first step, clamp 10 is mounted to lip 82 with first engagement surface 28 below angled flange 26 contacting rounded upper surface 85 of outwardly facing portion 90 of lip 82. Third engagement surface 66 of bumper bar 64 is positioned against hull 84. Turn knobs 18 are rotated to move jaw 14 towards bracket 12 to clamp lip 82 therebetween as shown in FIG. 8. In particular, jaw 14 is displaced by rotating turn knobs 18 so that tabs 56 are displaced toward inwardly facing portion 88 of lip 82. A portion of second engagement surface 58, along the insides of tabs 56, butts against inwardly facing portion 88 of lip 82. Another portion of second engagement surface 58, along the surface of floor 55, butts against the underside of lip 82.

First engagement surface 28 of bracket 12 and third engagement surface 66 of bumper formation 16 are urged against lip 82 and hull 84, respectively, as jaw 14 tightens against inwardly facing portion 88 of lip 82. Clamp 10 thus positively engages PWC 80 at three points of contact to provide firm, stable attachment of clamp 10 to lip 82.

Bumper formation 16 stops bracket 12 from rotating off lip 82 as jaw 14 is tightened. The clamping angle at which clamp 10 is clamped to lip 82 can be adjusted by adjusting the extension of bumper formation 16. FIGS. 7 and 8 show mounting flanges 40 extending generally vertically upwards from lip 82. The clamping angle can be adjusted by lengthening or shortening the extension of bumper formation 16 relative to base plates 32. Decreasing the extension of bumper formation 16 would angle flanges 40 outwardly as bracket 12 pivots about lip 82. Increasing or extending the length of bumper formation 16 would angle flanges 40 inwardly. Clamp 10 is also adapted to clamp to different sizes and configurations of lip 82 by lengthening or shortening the extension of bumper formation 16.

Clamp 10 is adjustable to fit many different sizes and configurations of a PWC lip. Bumper formation 16 is adjustable to set a desired clamping angle as described above. Arms 50 of jaw 14 can move up-and-down and in-and-out of slots 36 to be adaptable to clamp to the inside of different lip configurations and sizes.

Figure 9:
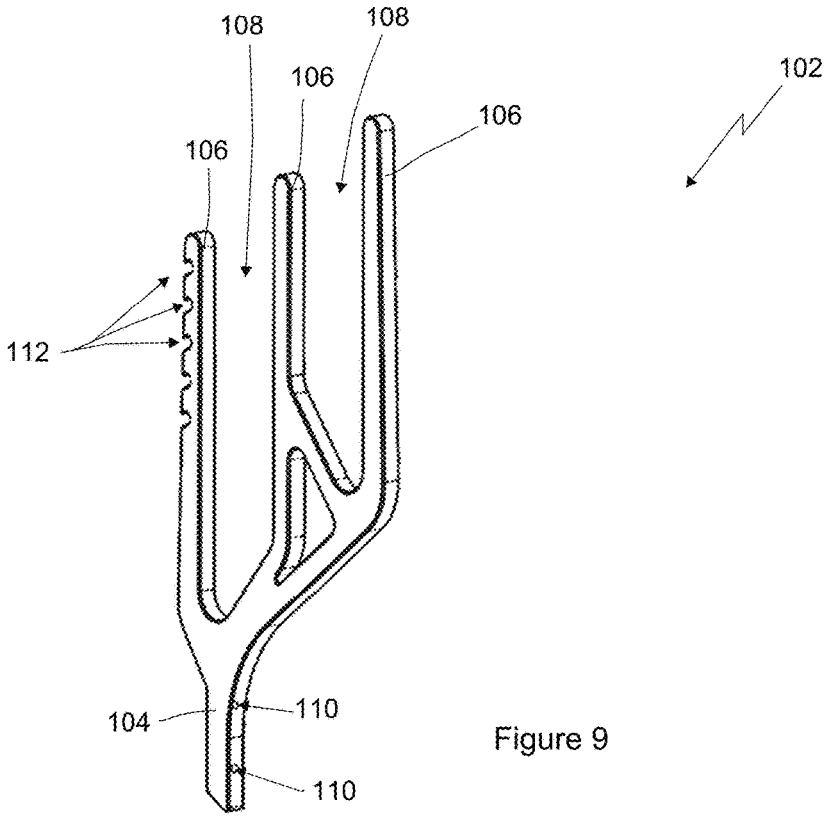
FIG. 9 is a perspective view of a carrier configured to carry equipment and to be mounted to the clamp of FIG. 1.

FIG. 9 shows a board carrier 102 configured to be mounted to clamp 10. Carrier 102 includes a foot 104 and three spaced apart posts 106 extending upwardly from foot 104. Posts 106 are spaced from each other so that carrier 102 defines two grooves or U-shaped engagement surfaces 108 configured to hold articles of sports equipment such as surfboards, wakeboards, kneeboards, wake skates, water ski's, or the like. Engagement surfaces 108 may be configured for friction fit or padded to protect the equipment being carried. Carrier 102 includes bolt holes 110 for receiving bolts 44 (FIG. 3) of clamp 10 to bolt carrier 102 to one of the mounting flanges 40. One of the posts 106 has a plurality of notches 112. Notches 112 are useful for gripping straps or cords that may be used to secure equipment in carrier 102. All of posts 106 may include hooks or notches if desired.

Figure 10:
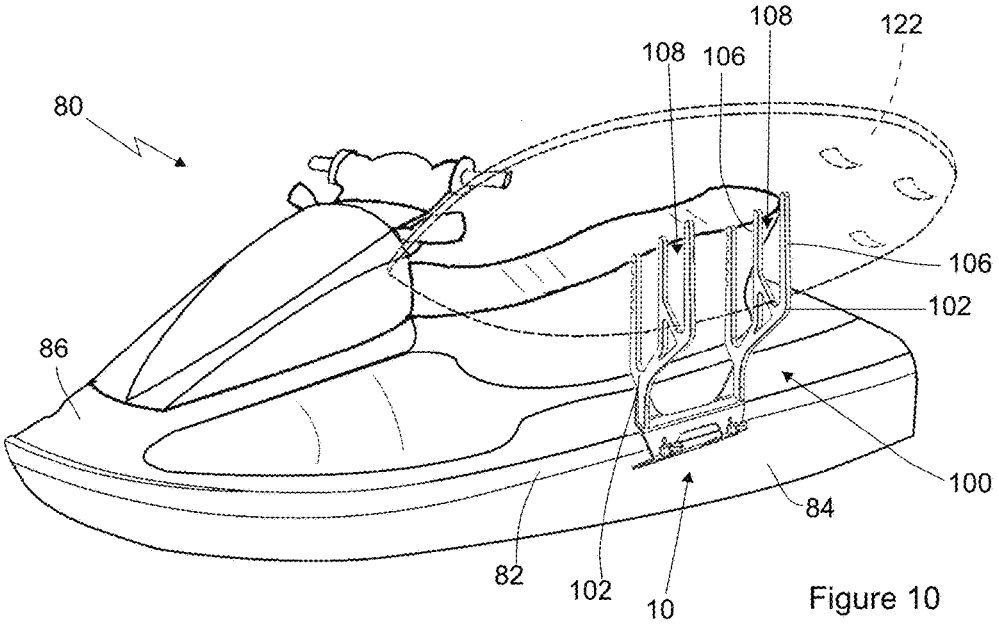
FIG. 10 is a perspective view of an equipment rack including the clamp of FIG. 1 clamped to the personal watercraft of FIG. 6, and the carrier of FIG. 9 mounted to the clamp.

Referring to FIG. 10, a rack 100 is shown including clamp 10 and two board carriers 102. Rack 100 is clamped to lip 82 of PWC 80.

Carriers 102 are each bolted to a different flange 40 of clamp 10. Carriers 102 are spaced from each other along the length of bracket 12. Each carrier 102 is located at different end of clamp 10.

Rack 100 supports a surfboard 122 shown in broken lines. Surfboard 122 is captured between two posts 106 of each carrier 102. The rail along one side of surfboard 122 rests on the bottom of U-shaped engagement surface 108. Different section of surfboard 122 is carried by different carriers 102.

Figure 11:
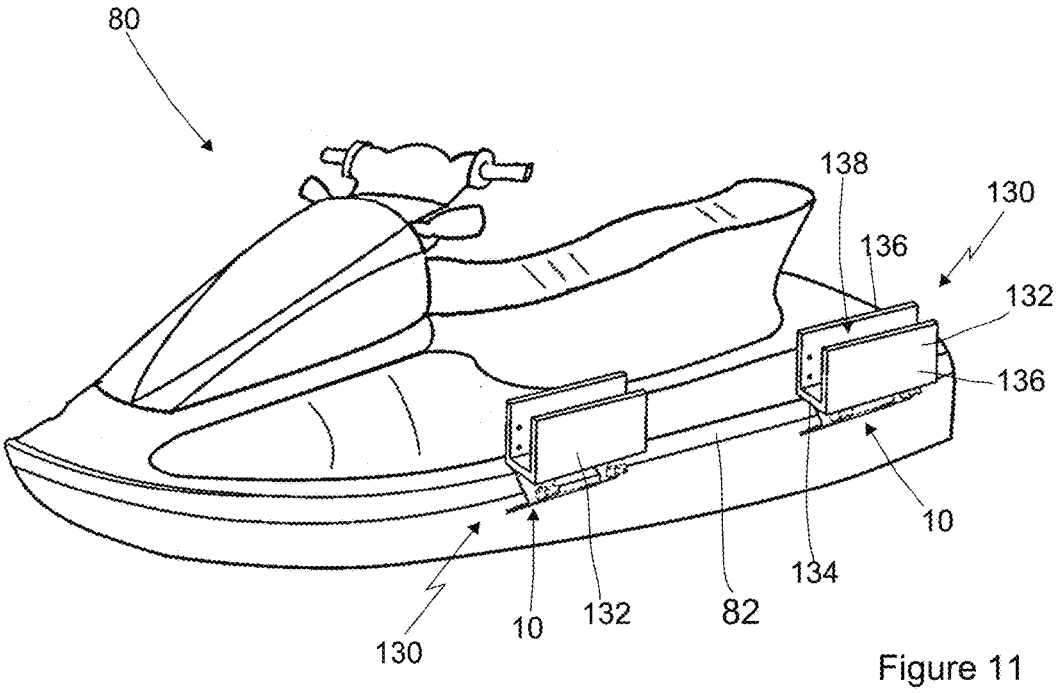
FIG. 11 is a perspective view of an equipment rack, for carrying sports equipment, clamped to the personal watercraft of FIG. 6.

Referring to FIG. 11, a rack 130 is shown including clamp 10 and a board carrier 132. Carrier 132 is bolted to flanges 40 of clamp 10. Carrier 132 is in the form of a U-shaped channel formation having a floor 134 and two parallel side walls 136. One of the side walls 136 has bolt holes for receiving bolts 44 (FIG. 3) to fix carrier 132 to clamp 10. Carrier 132 has a length, a height, a width and a wall thickness selected so that carrier defines a U-shaped engagement surface 138 configured to hold part of a board, rods, or water skis. Engagement surface 138 may be padded. FIG. 11 shows two racks 130 clamped to lip 82 of PWC 80. Racks 130 are spaced along one side of PWC 80. One rack 130 supports a forward section of the equipment being carried and the other rack 130 supports a rear section of the equipment.

Figure 12:
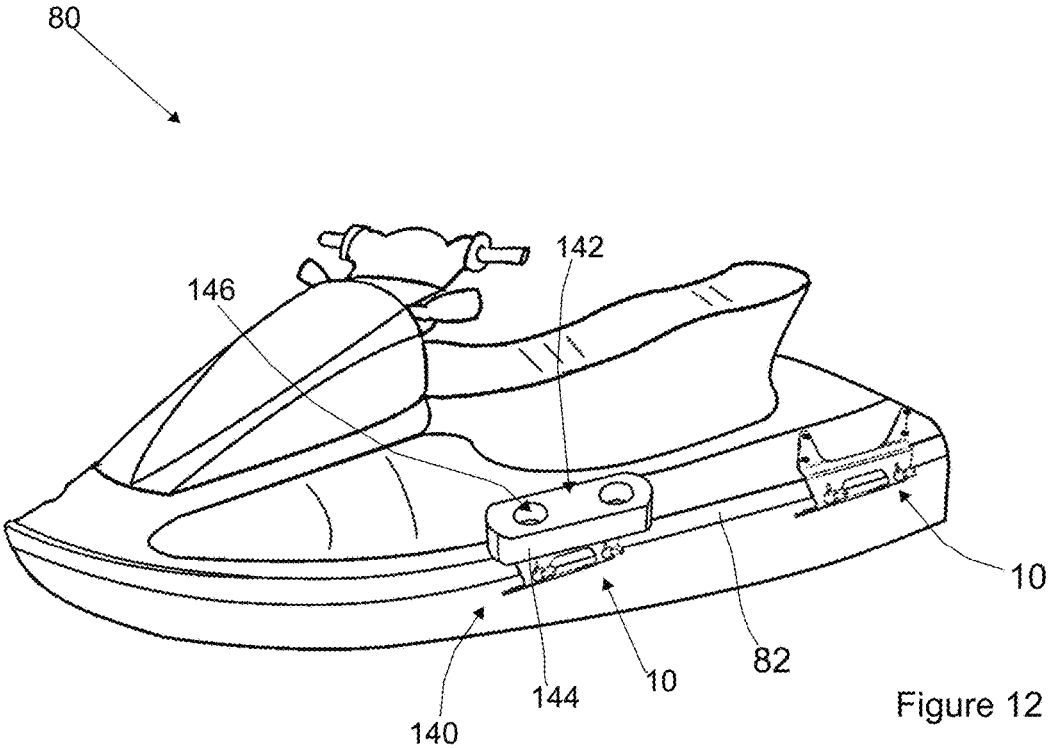
FIG. 12 is a perspective view of an equipment rack, for carrying sports equipment such as fishing rods, clamped to the personal watercraft of FIG. 6.

FIG. 12 shows a rack 140 including clamp 10 and a rod carrier 142. Rod carrier 142 includes a body 144 having sockets 146 in which handle ends of fishing rods can be held. One side of carrier 142 has bolt holes in a pattern to receive bolts 44 (FIG. 3) of clamp 10 to bolt carrier 142 to clamp 10.

FIGS. 13-16 show different forces acting on clamp 10 during normal operation of PWC 80. A PWC would go over bumps and waves in the water during normal operation, causing the PWC to bob and roll.

Figure 13:
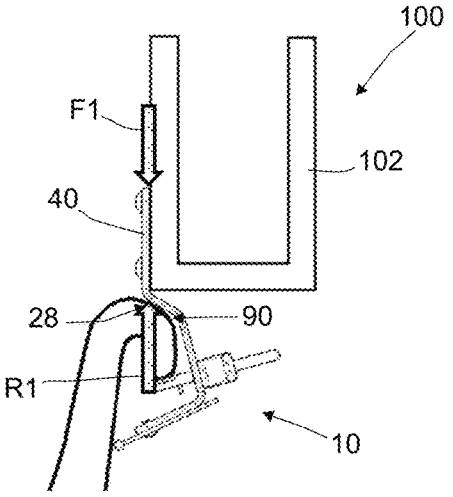
FIGS. 13-16 are sectional end views showing different forces acting on the clamp of FIG. 1, clamped to the personal watercraft of FIG. 6.

FIG. 13 shows a force "F1", which is the downward load force exerted by carrier 102 on flanges 40 due to the weight of carrier 102 and any equipment that may be carried by rack 100. Force "F1" is counteracted by reaction force "R1" where first engagement surface 28 contacts outwardly facing portion 90 of lip 82. Force "F1" may increase significantly as PWC 80 strikes the water after going over a bump or wave.

Figure 14:
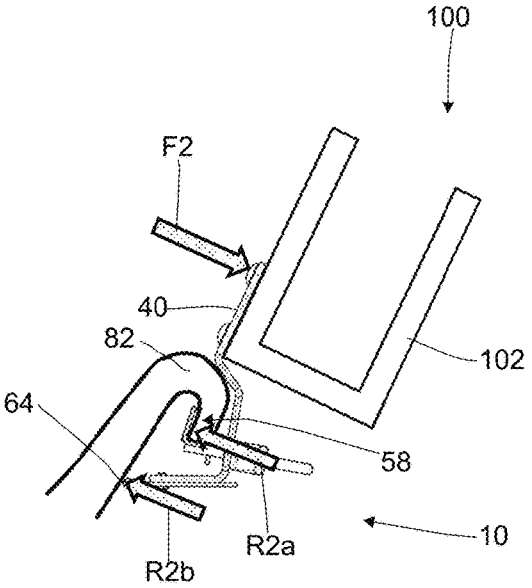

FIG. 14 shows a force "F2", which is the outward force on flanges 40 when PWC 80 has rolled to a side wherein carrier 102 is closer to the water, for example when turning. Force "F2" is counteracted by reaction forces "R2*a*" and "R2*b*". Reaction force "R2*a*" is where second engagement surface 58 of jaw 14 contacts the inside of lip 82. Reaction force "R2*b*" is where third engagement surface 66 of bumper formation 16 contacts hull 84. Force "F2" imparts a torsional force on bracket 12, due to possible rotation of bracket 12 about lip 82, which is counteracted by reaction force "R2*b*" where bumper bar 64 contacts hull 84.

Figure 15:
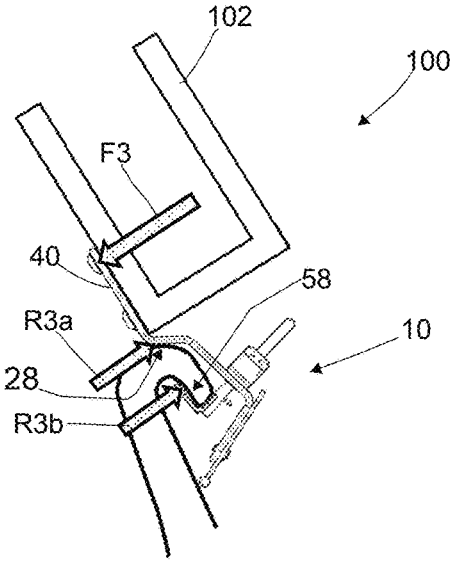

FIG. 15 shows a force "F3", which is the inward force on flanges 40 when PWC 80 has rolled to a side wherein carrier 102 is lifted away from the water. Force "F3" is counteracted by reaction forces "R3*a*" and "R3*b*". Reaction force "R3*a*" is where first engagement surface 28 contacts outwardly facing portion 90 of lip 82. Reaction force "R3*b*" is where second engagement surface 58 of jaw 14 contacts the inside of lip 82. Force "F3" imparts a torsional force on bracket 12, due to possible rotation of bracket 12 about lip 82, which is counteracted by reaction force "R3*b*" where tabs 56 contact the inside of lip 82.

Figure 16:
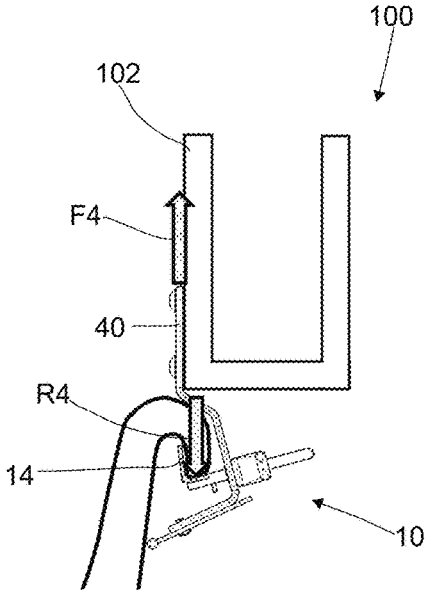

FIG. 16 shows a force "F4", which is the upward force exerted by carrier 102 on flanges 40 due to the momentum of carrier 102, and any equipment that may be carried by rack 100, in the upwards direction as PWC 80 is coming down. Force "F4" may be momentarily exerted as PWC 80 goes over bumps and waves. Force "F4" is counteracted by reaction force "R4" where second engagement surface 58 of jaw 14 contacts the underside of lip 82.

Flanges 40 with bolts 44 provide a universal mounting platform for fixing different carriers to clamp 10. Any carrier that has a bolt hole pattern to receive bolts 44 and a face to engage flanges 40 can be mounted to clamp 10.

Figure 17:
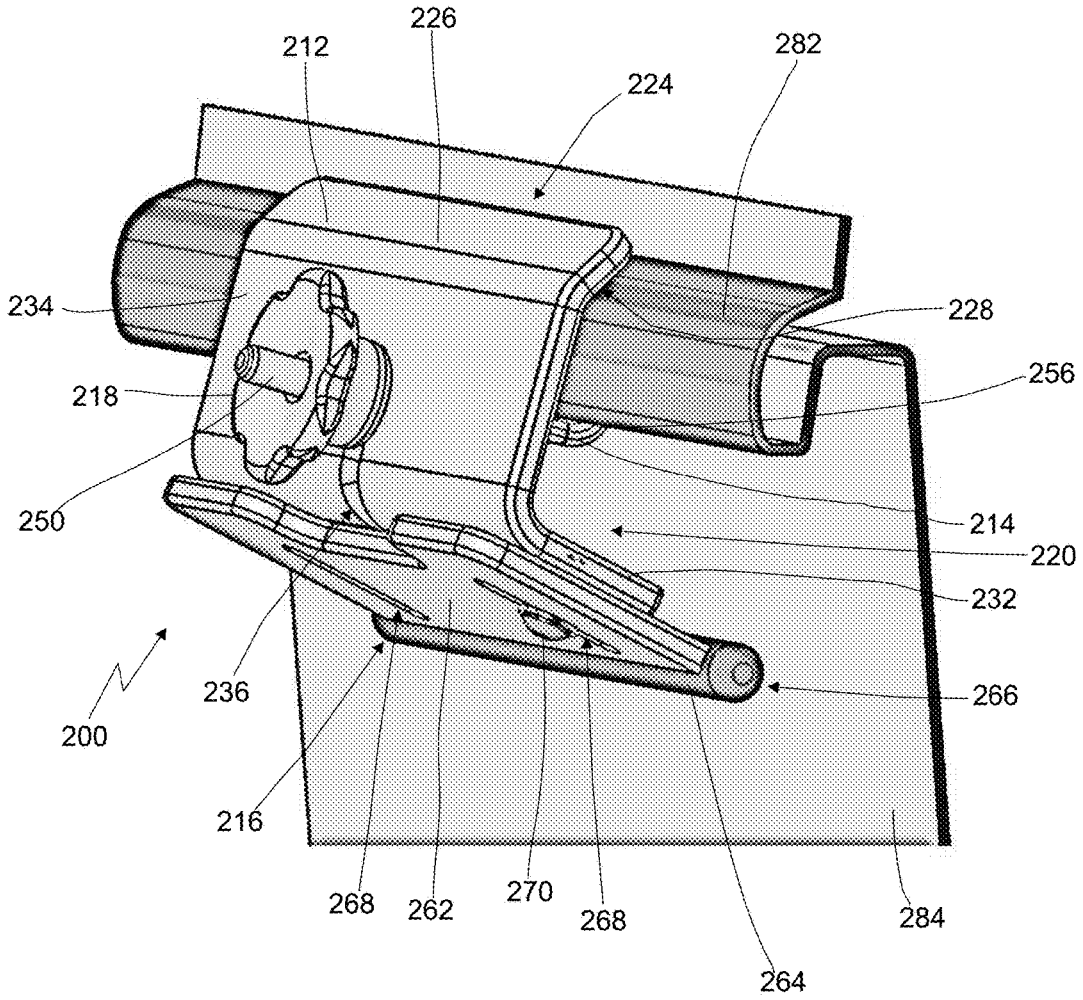
FIG. 17 is a perspective view of another embodiment of a clamp for clamping a carrier alongside a personal watercraft.
Figure 18:
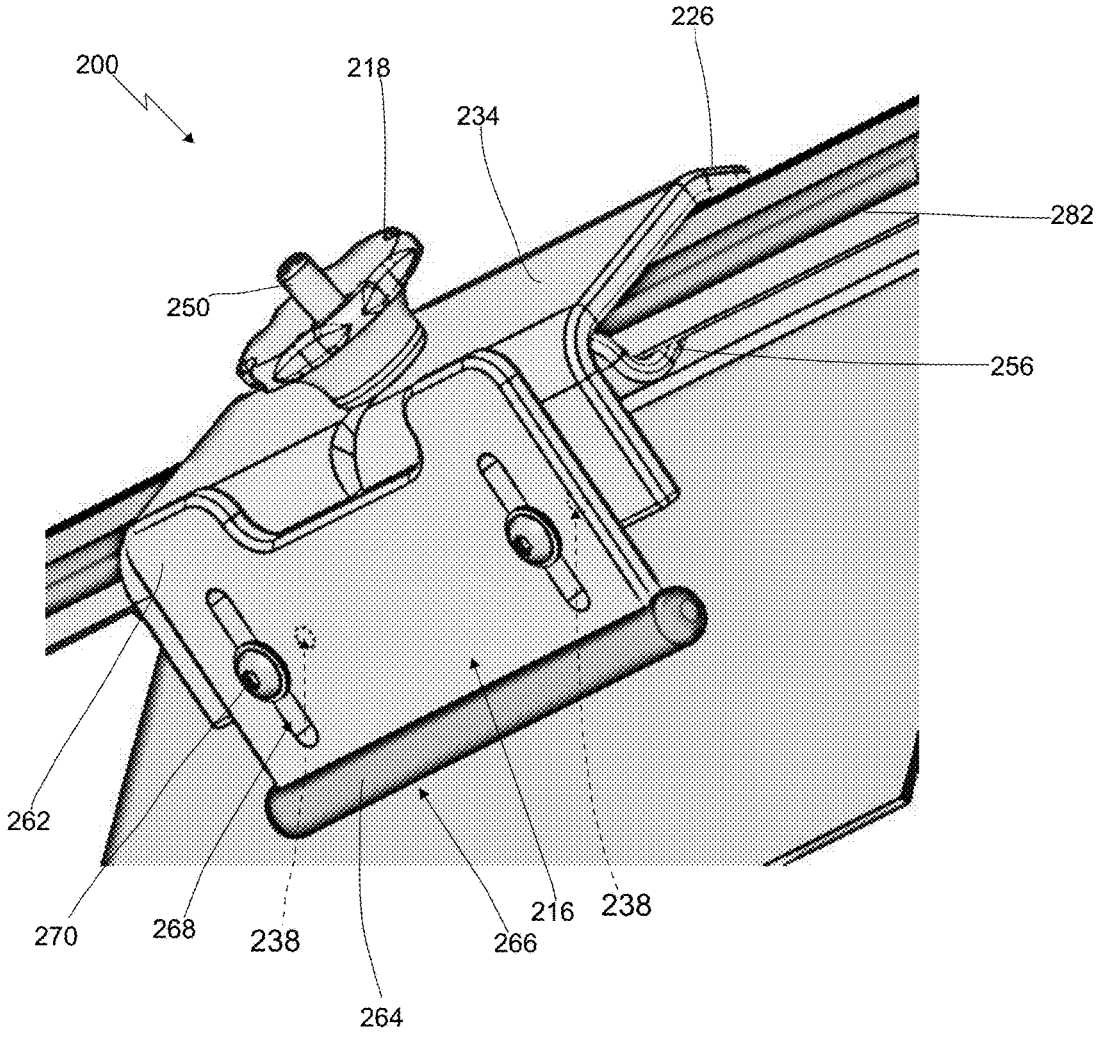
FIG. 18 is a bottom perspective view of the clamp of FIG. 17, clamped to a lip of a personal watercraft.
Figure 19:
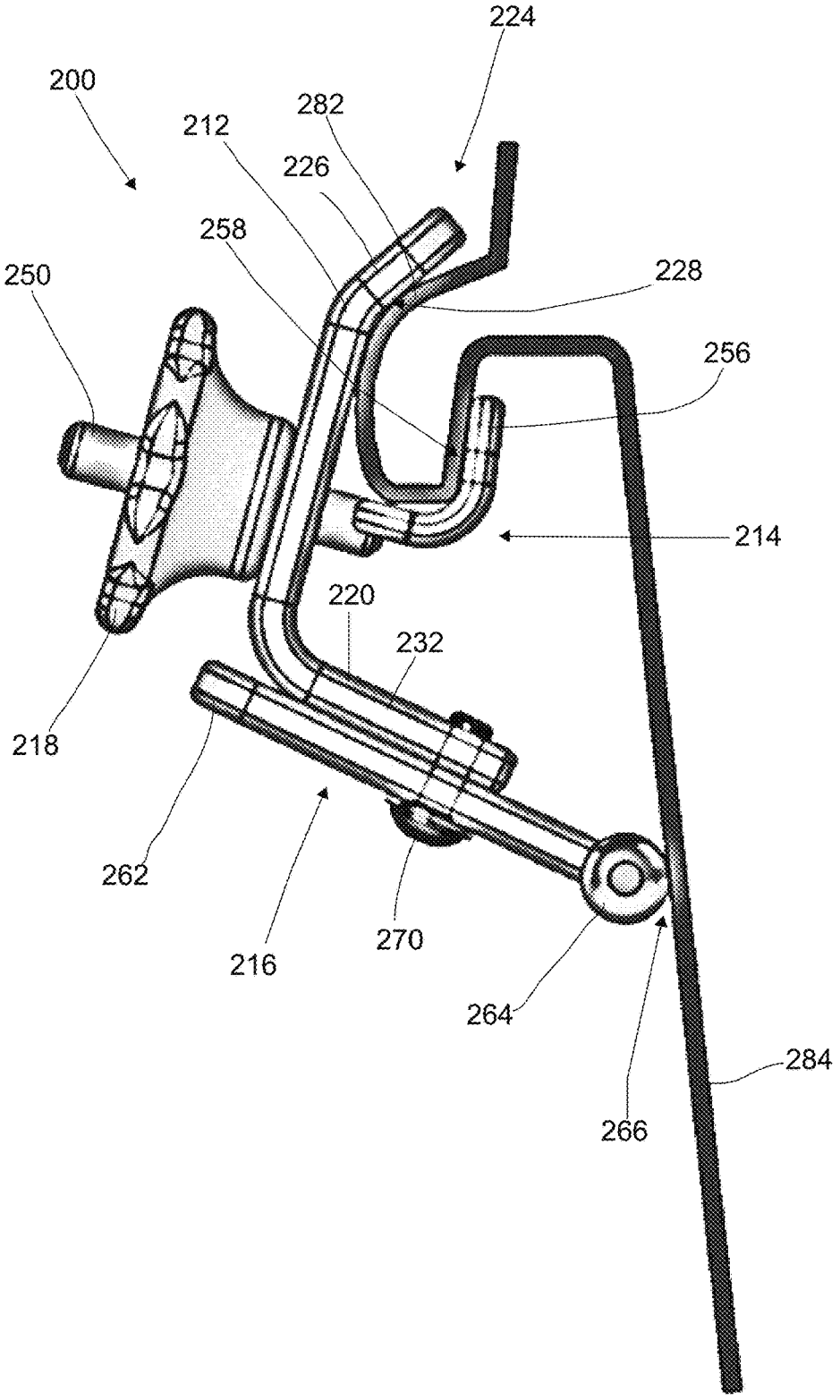
FIG. 19 is a sectional end view of the clamp of FIG. 17, clamped to a lip of a personal watercraft.

Referring to FIGS. 17-19, another embodiment of a clamp is indicated generally by reference numeral 200. Clamp 200 is similar to clamp 10, including a bracket 212, a moveable jaw 214, an adjustable bumper formation 216, and turn knobs 218.

Bracket 212 is generally L-shaped in end profile view, as shown in FIG. 17. Bracket 212 includes a foot portion 220, an upper free end 224, and angled flange 226 extending between foot portion 220 and free end 224. Whereas foot portion 20 of bracket 12 has two spaced-apart feet 30, foot portion 220 includes a single base plate 232 and a single web 234. Bracket 212 is integrally formed from a single plate. Foot portion 220 has a pair of spaced-apart threaded holes 238 for receiving screws or pins to fasten bumper formation 216 to bracket 212. Angled flange 226 defines a first engagement surface 228 on the inside of flange 226.

Referring to FIG. 15, an arm receiving aperture in the form of a central slot 236 is defined in web 234. Slot 236 extends from base plate 232 towards angled flange 226.

Jaw 214 includes a single arm 250 having a free end and a grip formation in the form of a transverse tab 256 at the other end. A second engagement surface 258 is defined along the inside of tab 256.

Jaw 214 is displaceable by rotating turn knobs 218 in the same manner as described for jaw 14.

Bumper formation 216 includes a slider plate 262 and a bumper bar 264 at a distal edge of slider plate 262. A third engagement surface 266 is defined on the outside of bumper bar 264. Referring to FIGS. 15 and 16, slider plate 262 has two parallel slots 268 for receiving a shank of a threaded fastener 270 to releasably secure bumper formation 216 to bracket 212. Fastener 270 is in the form of a screw which can be released to have bumper formation 216 slide forwards and backwards and tightened to secure bumper formation at an elected extension from base plate 232.

Clamp 200 does not show a mounting formation, such as mounting flanges 40 of clamp 10, to secure a carrier to clamp 200. It will be appreciated that a suitable mounting formation may be fixed to clamp 100 or integrally formed with bracket 212. For example only, free end 224 may have a number of holes for receiving bolts to bolt a carrier to bracket 212.

Clamp 200 engages a lip 282 shown in FIGS. 17-19 in the same manner as clamp 10 engages lip 82. Lip 282 extends from hull 284 which bumper formation 216 engages to set the clamp angle.

Figure 20:
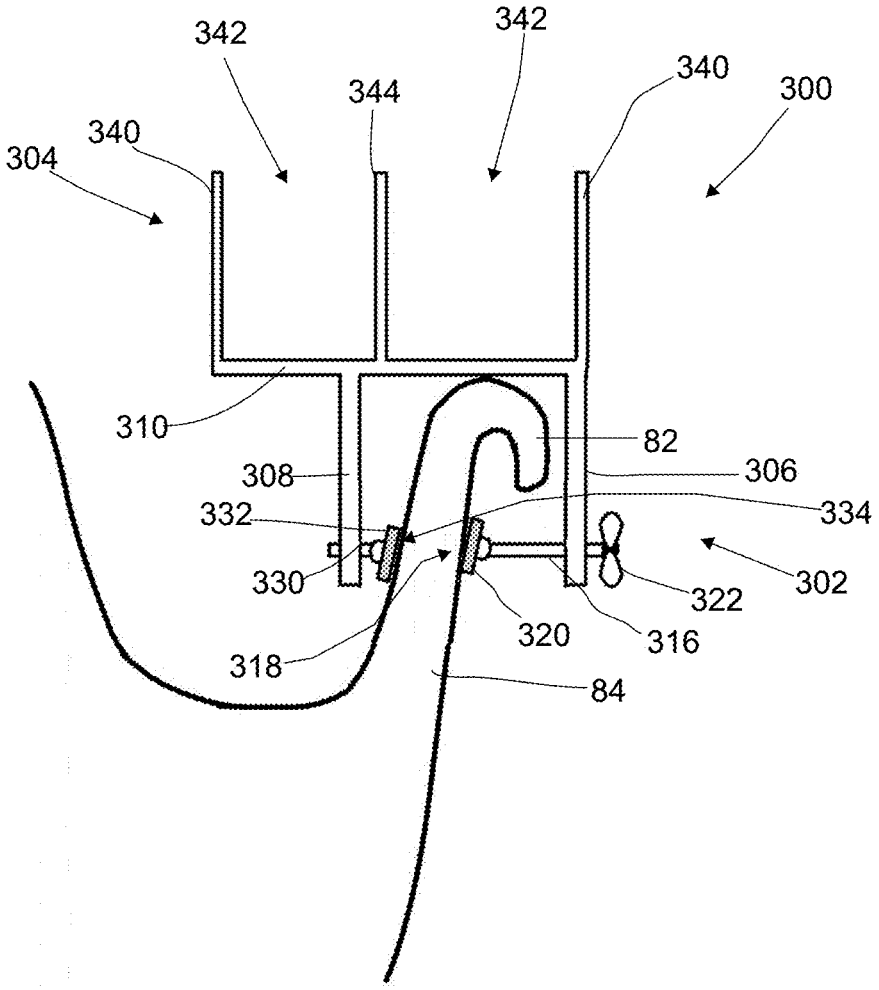
FIG. 20 is an end view of another embodiment of a rack clamped to the lip of the personal watercraft of FIG. 6.

FIG. 20 shows another embodiment of a rack 300 including a clamp 302 and a carrier 304. Clamp 302 and carrier 304 are integrally formed.

Clamp 302 includes an outer leg 306 and an inner leg 308. Legs 306, 308 are connected by a base 310, which forms the base of carrier 304. Outer leg 306 includes a moveable arm 316. Arm 316 includes a foot 320 at one end and a finger grip 322 at the other end. Arm 316 screws into outer leg 306 to be able to move in a direction transverse to the extension of leg 306. Foot 320 defines a first engagement surface 318 which engages outwardly facing portion of hull 84.

Inner leg 308 includes an arm 330 extending to an inwardly facing portion of hull 84. Arm 330 includes a foot 332 defining a second engagement surface 334. Clamp 302 is clamped to the hull 84 by displacing arm 316 to urge against the outside of hull 84, thereby clamping a portion of hull 84 between legs 306, 308. Base 310 rests on top of lip 82, though it will be appreciated that it may be spaced-apart if desired.

Carrier 304 includes two U-shaped channels 340 defining two generally U-shaped engagement surfaces 342 configured to hold sports equipment. The two U-shaped channels 340 are side-by-side, divided by a common post or wall 344.

Figure 21:
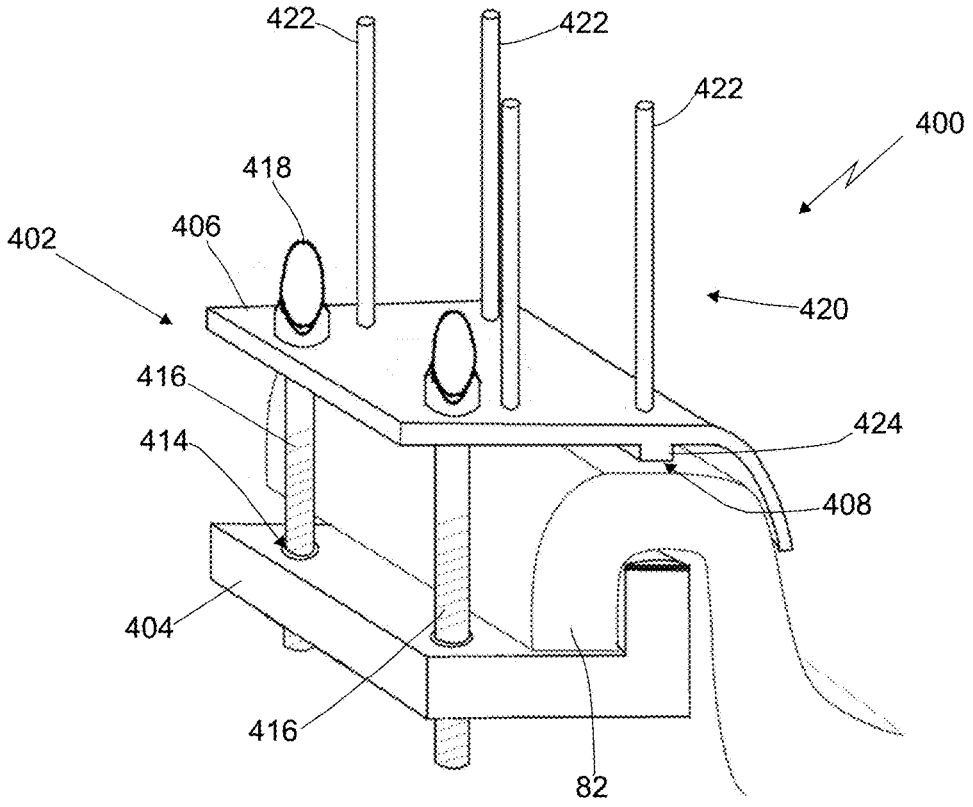
FIG. 21 is a perspective view of another embodiment of a clamp, clamped to the lip of a personal watercraft.

FIG. 21 shows another embodiment of a rack 400 including a clamp 402, clamped to lip 82. Clamp 402 includes a top plate 406 and a jaw 404. Top plate 406 defines a first engagement surface 408 configured to engage the top of lip 82. Jaw 404 defines a second engagement surface 410 configured to engage the inside of lip 82. Second engagement surface 410 is defined by a shoulder 412 configured to hook under lip 82.

Jaw 404 has two spaced apart threaded holes 414. Top plate 406 includes two holes (not shown) which align with holes 414 in jaw 404. Clamp 402 includes two screws 416 which pass through the holes in top plate 406 and screw into threaded holes 414 in jaw 404. Screws 416 have heads 418 which bear against the outside of top plate 406. Heads 418 are configured to be rotated by hand.

Continuing with reference to FIG. 21, rack 400 also includes a carrier 420 having a plurality of posts 422 projecting from top plate 406. Top plate 406 also includes a shoulder 424 configured to engage an upper surface of the lip.

Clamp 402 is clamped to lip 82 by rotating screws 416 so that top plate 406 and jaw 404 are urged towards each other, clamping lip 82 between shoulder 424 and a foot of jaw 404.

Top plate 406 is configured to follow the contour of the top of lip 82 in order to facilitate gripping onto lip 82.

Clamps 10, 200 each provide a simple and secure way of carrying accessories on a PWC. Many different types of carriers can be mounted the PWC using the universal mounts provided by flanges 40. The three engagement surfaces provide at least three points of engagement where each clamp urges against the PWC when clamped to the lip to provide a rigid and secure attachment.

It will be appreciated that the clamp may be used to mount a wide variety of equipment to a PWC. For example only, the clamp may be used to mount racks, holders, frames, carriers, adapters, or anything else a user may want to mount to the PWC.

The clamp may also be used to mount carriers to other types of personal recreational craft or transport, other than PWC. The clamp may clamp a carrier to any personal transport having a lip or a lip-like formation. For example only, the clamp may clamp to the lip or lip-like formation of a snowmobile, boat, all-terrain vehicle, motorcycle, bicycle, vehicle roof, or any other personal transport.

The foregoing description is by way of example only, and may be varied considerably without departing from the scope of the present disclosure. For example only, the shape of the bracket may be formed in a variety of ways (e.g., any number of feet 30 and any number or shapes of mounting flanges 40.) The carrier may have any number of engagement sockets or grooves. The carrier may be fixed to the clamp in any number of ways, including being welded together, integrally formed together, bolted together or clipped together. The carrier may have any shape or configuration of engagement surface for supporting different types of articles that may be carried. The carrier may have hooks, slots, grooves, sockets, channels, posts, spigots, apertures, straps, walls, brackets, collars or other engagement surfaces. Each clamp may support any number of carriers, for example one carrier as shown for rack 130, two carrier as shown for rack 100, or any other number of carriers. The clamp may support a carrier or frame between spaced apart clamps. For example, two or more clamps may be attached to opposite sides of PWC and a carrier in the form of a carrier frame or rack may extend across PWC from the one side to the opposite side to be supported by clamps. The rack may support equipment above the deck of a personal watercraft.

References to "left," "right" and "rear" and "front", "inside" and "outside" are for illustrative convenience only as would be appreciated by a person skilled in the art.

The features described with respect to one embodiment may be applied to other embodiments, or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A rack for carrying sports equipment alongside a personal watercraft having a hull and a lip extending along a top portion of the hull, comprising:

a clamp sized and configured to engage the lip of the personal watercraft, said clamp having a first engagement surface configured to engage an outwardly-facing portion of the lip, said clamp having a second engagement surface configured to engage an inwardly-facing portion of the lip, said second engagement surface being retractable relative to said first engagement surface, said first engagement surface including a slot configured to receive a portion of said second engagement surface therethrough, wherein said second engagement surface is configured to move away from a longitudinal centerline of the personal watercraft and towards said first engagement surface to clamp the lip of the personal watercraft therebetween;

a hull support plate moveably connected to said clamp, said hull support plate having a surface configured to engage an outer surface of the hull of the water craft, said hull support plate being configured to extend or retract relative to the outer surface of the hull to angle said clamp about the lip; and a carrier extending from said clamp, said carrier having a length, a height, and at least one generally U-shaped engagement surface configured to hold an article of sports equipment.

2. The rack of claim 1, wherein said second engagement surface is generally L-shaped.

3. The rack of claim 1, wherein movement of said first engagement surface and said second engagement surface towards each other requires rotation.

4. The rack of claim 3, wherein the rotation is about an axis parallel to a central longitudinal axis of said aperture.

5. The rack of claim 1, further comprising a turn knob configured to engage a portion of said second engagement surface to move said second engagement surface towards said first engagement surface.

6. The rack of claim 1, wherein said first engagement surface is generally L-shaped, said first engagement surface having a foot portion and an upper free-end.

7. The rack of claim 6, wherein said foot portion of said first engagement surface is configured to adjustably engage said hull support plate.

8. The rack of claim 1, wherein said hull support plate includes a bumper having a free end having a foam or rubber hull engagement surface.

9. The rack of claim 1, wherein said hull support plate includes at least one aperture for receiving a fastener to removably fasten said hull support plate to said first engagement surface.

10. The rack of claim 9, wherein said hull support plate has a length and a width, said at least one aperture being a slot or a series of holes extending perpendicular to the length of said third engagement surface.

11. The rack of claim 1, wherein said hull support plate is moveable along a direction generally parallel to the direction of movement between said first engagement surface and said second engagement surface.

12. The rack of claim 1, wherein said first engagement surface is formed as a plate.

13. The rack of claim 1, wherein said carrier is removably attachable to said clamp.

14. The rack of claim 1, wherein said carrier includes a plurality of substantially U-shaped engagement surfaces.

15. The rack of claim 1, wherein said carrier is configured to hold a surfboard.

16. A clamp for attaching an equipment carrier alongside a personal watercraft having a hull, comprising:

a first engagement surface configured to engage an outwardly-facing portion of the hull;

a second engagement surface moveably connected to said first engagement surface, said second engagement surface being configured to move towards said first engagement surface to clamp a portion of the hull therebetween, said first engagement surface including a slot configured to receive a portion of said second engagement surface therethrough, wherein said second engagement surface is configured to move away from a longitudinal centerline of the personal watercraft and towards said first engagement surface to clamp the hull of the personal watercraft therebetween; and a third engagement surface moveably connected to said first engagement surface, said third engagement surface being moveable relative to said first engagement surface and configured to stabilize a clamping angle of said first engagement surface and said second engagement surface relative to the hull of the personal watercraft when a portion of said third engagement surface is engaged to an outer surface of the hull.

17. The clamp of claim 16, wherein said second engagement surface is generally L-shaped.

18. The clamp of claim 16, wherein movement of said first engagement surface and said second engagement surface towards each other requires rotation.

19. The clamp of claim 18, wherein the rotation is about an axis parallel to a central longitudinal axis of said aperture.

20. The clamp of claim 16, further comprising a turn knob configured to engage a portion of said second engagement surface to move said second engagement surface towards said first engagement surface.

21. The clamp of claim 16, wherein said first engagement surface is generally L-shaped, said first engagement surface having a foot portion and an upper free end.

22. The clamp of claim 21, wherein said foot portion of said first engagement surface is configured to adjustably engage said third engagement surface.

23. The clamp of claim 16, wherein said third engagement surface has a free end which includes a foam or rubber hull engagement surface.

24. The clamp of claim 16, wherein said third engagement surface includes at least one aperture for receiving a fastener to removably fasten said third engagement surface to said first engagement surface.

25. The clamp of claim 24, wherein said third engagement surface is a plate having a length and a width, said aperture being a slot or a series of holes extending perpendicular to the length of said third engagement surface.

26. The clamp of claim 16, wherein said third engagement surface is moveable along a direction generally parallel to the direction of movement between said first engagement surface and said second engagement surface.

27. The clamp of claim 16, wherein said first engagement surface is formed as a plate.

28. The clamp of claim 16, wherein said third engagement surface includes an aperture, the clamp further comprising a fastener configured to engage a portion of said first engagement surface with a portion of said third engagement surface.

29. The clamp of claim 28, wherein said first engagement surface includes an aperture configured to receive a projection of said second surface therethrough, said projection having a central longitudinal axis, said fastener having a central longitudinal axis generally perpendicular to the central longitudinal axis of said projection when said fastener is engaged with said first engagement surface and said third engagement surface.

30. The rack of claim 1, wherein said second engagement surface is retractable below a portion of said U-shaped engagement surface of said carrier when the rack is engaged to the personal watercraft.

31. The rack of claim 1, further comprising a first adjustment mechanism for adjusting a distance between said first engagement surface and said second engagement surface, and a second adjustment mechanism for controlling extension and retraction of said hull support plate relative to the hull, both of said first adjustment mechanism and said second adjustment mechanism being oriented outside the hull of the personal watercraft when the rack is engaged to the watercraft.

* * * * *